US006596127B2

(12) United States Patent
Hollmark et al.

(10) Patent No.: US 6,596,127 B2
(45) Date of Patent: Jul. 22, 2003

(54) METHOD OF PRODUCING A PAPER HAVING A THREE-DIMENSIONAL PATTERN

(75) Inventors: Holger Hollmark, Stockholm (SE); Lennart Reiner, Matfors (SE); Thomas Billgren, Kullavik (SE); Kaveh Tondkar, Göteborg (SE); Mats Söderberg, Sundvall (SE); Bengt Järrehult, Göteborg (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 09/822,366

(22) Filed: Apr. 2, 2001

(65) Prior Publication Data

US 2002/0060008 A1 May 23, 2002

Related U.S. Application Data

(63) Continuation of application No. PCT/SE99/01724, filed on Sep. 29, 1999.

(30) Foreign Application Priority Data

Oct. 1, 1998 (SE) ..... 9803362

(51) Int. Cl.[7] ..... D21F 11/00; D21F 3/02

(52) U.S. Cl. ..... 162/206; 162/117; 162/109

(58) Field of Search ..... 162/109, 111, 162/113, 116, 117, 204, 205–207, 361, 362, 358.5; 34/397–400, 423–426, 419, 442, 444, 446

(56) References Cited

U.S. PATENT DOCUMENTS

| | | | | | |
|---|---|---|---|---|---|
| 4,324,613 | A | * | 4/1982 | Wahren | 162/111 |
| 5,126,015 | A | * | 6/1992 | Pounder | 162/206 |
| 5,327,661 | A | | 7/1994 | Orloff | |
| 5,404,654 | A | * | 4/1995 | Babinsky et al. | 34/122 |
| 5,439,559 | A | * | 8/1995 | Crouse | 162/358.5 |
| 5,598,642 | A | * | 2/1997 | Orloff et al. | 34/388 |
| 6,049,998 | A | * | 4/2000 | Crouse et al. | 34/445 |
| 6,223,450 | B1 | * | 5/2001 | Banerjee | 34/116 |
| 6,309,512 | B1 | * | 10/2001 | Bengtsson et al. | 162/358.5 |
| 2002/0179269 | A1 | * | 12/2002 | Klerelid | 162/206 |

FOREIGN PATENT DOCUMENTS

| | | |
|---|---|---|
| EP | 0 490 655 | 6/1992 |
| EP | 0796945 A2 | 9/1997 |
| WO | 93/23613 | 11/1993 |
| WO | 97/16593 | 5/1997 |

* cited by examiner

*Primary Examiner*—Jose A. Fortuna
(74) *Attorney, Agent, or Firm*—Young &Thompson

(57) ABSTRACT

Method of producing a paper having a three-dimensional pattern of alternating raised and recessed portions which has been provided in connection with impulse drying, at which the wet paper web (10) is passed through at least one press nip (12) comprising a rotatable roll (13) which is heated and that the paper web during the passage through the press nip is given a three-dimensional pattern of alternating raised and recessed portions either by means of a pattern wire, band or belt and/or by a pattern on the heated roll (13) and where the paper web (10) after said press nip (12) is led around an essential part of the periphery of the heated roll (13) in order to provide an additional drying of the paper web while this is still in contact with said three-dimensional pattern.

6 Claims, 1 Drawing Sheet

METHOD OF PRODUCING A PAPER HAVING A THREE-DIMENSIONAL PATTERN

This is a continuation of co-pending international application No. PCT/SE99/01724 filed on Sep. 29, 1999, which designated the United States of America.

TECHNICAL FIELD

The present invention refers to a method of producing a paper having a three dimensional pattern of alternating raised and recessed portions, which has been provided in connection with impulse drying, at which the wet paper web is passed through at least one press nip comprising a rotatable roll which is heated and that the paper web during the passage through the press nip is given a three dimensional pattern of alternating raised and recessed portions either by means of a patterned wire, band or belt and/or by a pattern on the heated roll and where said pattern is pressed into the paper web against a counter means.

BACKGROUND OF THE INVENTION

Moist paper webs are usually dried against one or more heated rolls. A method which is commonly used for tissue paper is so called Yankee drying. At Yankee drying the moist paper web is pressed against a steam-heated Yankee cylinder, which can have a very large diameter. Further heat for drying is supplied by blowing of heated air. If the paper to be produced is soft paper the paper web is usually creped against the Yankee cylinder. The drying against the Yankee cylinder is preceded by a vacuum dewatering and a wet pressing, in which the water is mechanically pressed out of the paper web.

Another drying method is so called through-air-drying (TAD). In this method the paper is dried by means of hot air which is blown through the moist paper web, often without a preceding wet pressing. The paper web which enters the through-air-dryer is then only vacuum dewatered and has a dry content of about 25–30% and is dried in the through-air-dryer to a dry content of about 65–95%. The paper web is transferred to a special drying fabric and is passed over a so called TAD cylinder having an open structure. Hot air is blown through the paper web during its passage over the TAD cylinder. Paper produced in this way, mainly soft paper, becomes very soft and bulky. The method however is very energy-consuming since all water that is removed has to be evaporated. In connection with the TAD drying the pattern structure of the drying fabric is transferred to the paper web. This structure is essentially maintained also in wet condition of the paper, since it has been imparted to the wet paper web. A description of the TAD technique can be found in e.g. U.S. Pat. No. 3,301,746.

Impulse drying of a paper web is disclosed in e.g. SE-B-423 118 and shortly involves that the moist paper web is passed through the press nip between a press roll and a heated roll, which is heated to such a high temperature that a quick and strong steam generation occurs in the interface between the moist paper web and the heated roll. The heating of the roll is e.g. accomplished by gas burners or other heating devices, e.g. by means of electromagnetic induction. By the fact that the heat transfer to the paper mainly occurs in a press nip an extraordinarily high heat transfer speed is obtained. All water that is removed from the paper web during the impulse drying is not evaporated, but the steam on its way through the paper web carries along water from the pores between the fibers in the paper web. The drying efficiency becomes by this very high.

In EP-A-0 490 655 there is disclosed the production of a paper web, especially soft paper, where the paper simultaneously with impulse drying is given an embossed surface.

This embossment is made by pressing a pattern into the paper from one or both sides against a hard holder-on. This gives a compression of the paper and by this a higher density in certain portions just opposite the impressions and a lower density in the intermediate portions.

THE OBJECT AND MOST IMPORTANT FEATURES OF THE INVENTION

The object of the present invention is to provide a method of producing an impulse dried paper having a three-dimensional pattern, e.g. a soft paper intended as toilet paper, kitchen rolls, paper handkerchiefs, table napkins and the like, and where the paper has a high bulk, high elasticity and a high softness. The structure of the paper should further be essentially maintained also in wet condition. It is a further object that the method should provide as complete drying as possible of the paper web in direct connection to the impulse drying in order to eliminate or reduce the necessity of a further drying step. This has according to the invention been provided by the fact that the paper web after said press nip is led around an essential part of the periphery of the heated roll in order to provide an additional drying of the paper web while this is still in contact with said three dimensional pattern.

According to a preferred embodiment of the invention the paper web encloses at least 180°, preferably at least 270° of the periphery of the heated roll.

A further heating of the paper web takes place in the post-drying section besides the heating that takes place by the heated roll.

Further features and advantages of the invention are disclosed in the following description and in the dependant claims.

BRIEF DESCRIPTION OF THE DRAWINGS

The invention will in the following be closer described with reference to some embodiments shown in the accompanying drawings.

DESCRIPTION OF THE INVENTION

Figure 1:
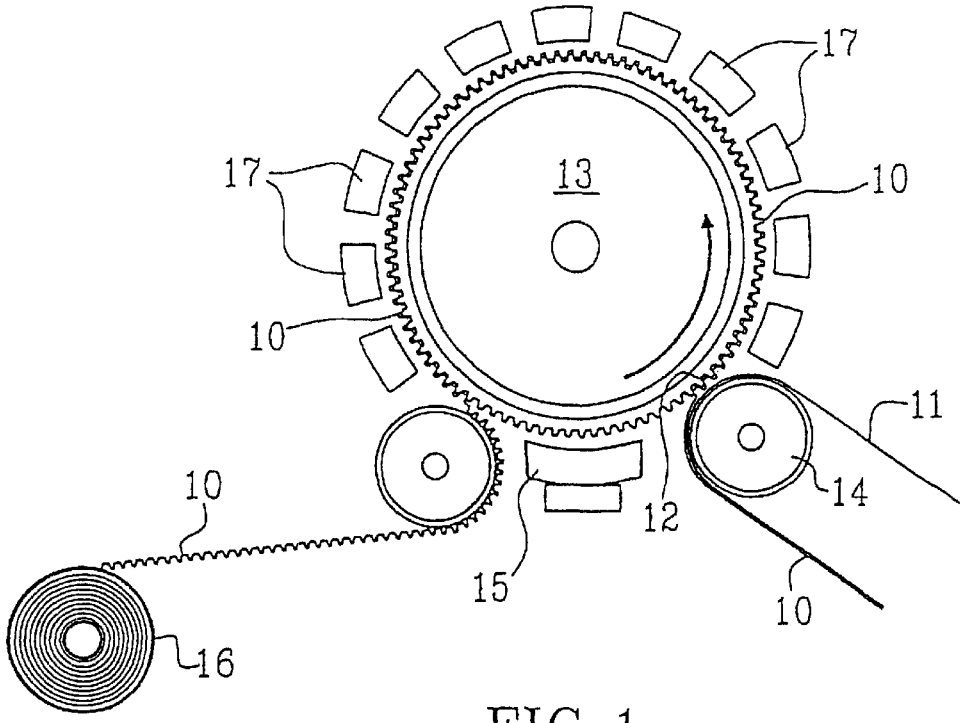
FIGS. 1 and 2 are schematic side views of an impulse drying device according to two different embodiments.

FIG. 1 shows schematically a device for performing impulse drying of a paper web. The wet paper web 10 which is dewatered over suction boxes (not shown) is supported by a wire or felt 11 and is brought into a press nip 12 between two rotatable rolls 13 and 14, at which the roll 13 which is in contact with the paper web is by a heating device 15 heated to a temperature which is sufficiently high for providing drying of the paper web. The surface temperature of the heated roll can vary depending on such factors as the moisture content of the paper web, thickness of the paper web, the contact time between the paper web and the roll and the desired moisture content of the completed paper web. The surface temperature should of course not be so high the paper web is damaged. An appropriate temperature should be in the interval 100–400° C., preferably 150–350° C. and most preferably 200–350° C.

The paper web is pressed against the heated roll 13 by means of the roll 14. The press device may of course be designed in many other ways. Two and more press devices may also be arranged after each other. The holder-on 14 may also be a press shoe. It is also possible that the paper web 10 is passed into the press nip unsupported, i.e. not supported by any wire or felt.

A very rapid, violent and almost explosive steam generation takes place in the interface between the heated roll 13 and the moist paper web, at which the generated steam on its way through the paper web carries away water. For a further description of the impulse drying technique reference is made to the above mentioned SE-B-423 118 and e.g. to EP-A-0 337 973 and U.S. Pat. No. 5,556,511.

The paper web 10 is after said press nip 12 led around an essential part of the periphery of the heated roll 13 in order to provide an after-drying of the paper web while this is still in contact with three dimensional pattern of the roll 13. The paper web should encloses at least 180°, preferably at least 270° of the periphery of the heated roll 13. By this the paper web will be in contact with the pattern of the roll 13 during the entire drying process, which means that a further stabilization of the pattern structure given the paper in connection with the impulse drying.

Figure 2:
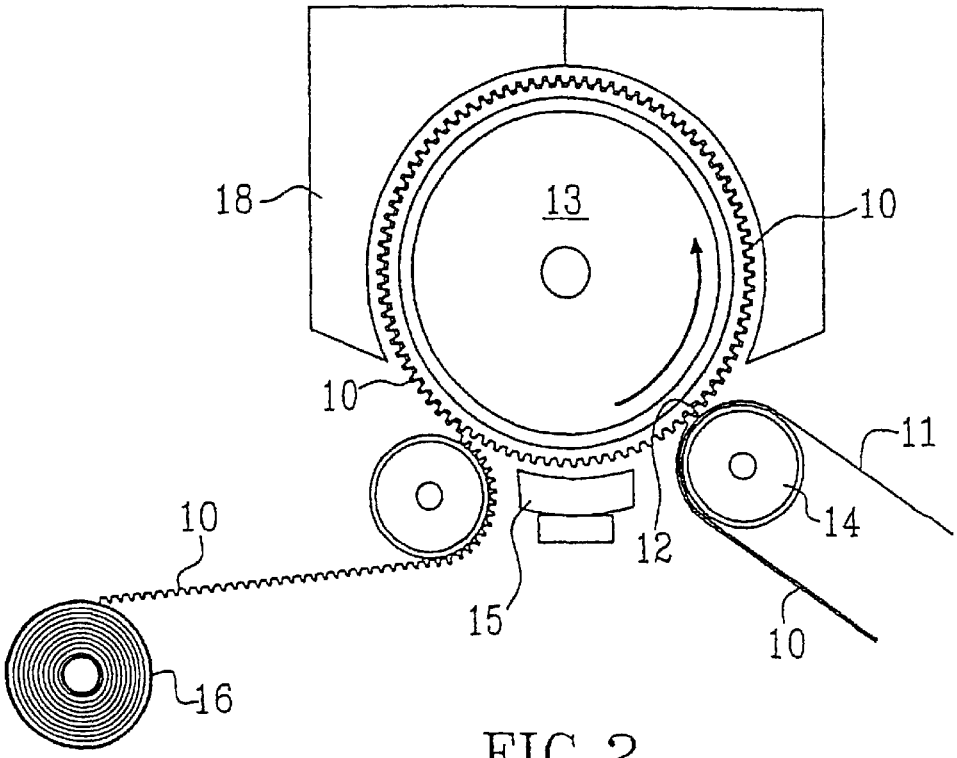

A further heating of the paper web may also take place in said after-drying station besides the heating which is made by the heated roll 13. According to the embodiment in FIG. 1 this heating is made by means of an infrared unit 17 arranged about the periphery of the roll 13, while in FIG. 2 the roll 13 is surrounded by a so called high-velocity hood 18 common at tissue manufacturing and in which the hot flue gases from a gas burner supplies further drying energy to the paper.

The paper is after drying wound on a wind-up roll 16. It is noted that the need for creping the paper in order to impart softness and bulk which is aimed at for soft paper, is reduced when using the impulse drying method according to the invention, since the paper by the three-dimensional structure and the chosen pattern is imparted bulk and softness.

The paper web can before it is brought into the impulse dryer either can be only dewatered over suction boxes or besides slightly pressed.

Simultaneously with the impulse drying the paper is given a three-dimensional structure. This can be made as shown in FIG. 1 by the fact that the heated roll 13 is provided with an embossing pattern consisting of alternating raised and recessed areas. This structure is substantially maintained also in a later wetted condition of the paper, since it has been imparted the wet paper web in connection with drying thereof. Since the term embossing is normally used for a shaping performed on dried paper we have in the following used the term press moulding for the three-dimensional shaping of the paper that occurs simultaneously with the impulse drying. By this press moulding the bulk and absorption capacity of the paper is increased, which are important qualities for soft paper.

The paper can be pressed against a non-rigid surface, i.e. a compressible press felt 11. The roll 14 can also have an elastically yielding surface, e.g. an envelope surface or rubber. The paper is herewith given a three-dimensional structure the total thickness of which is greater than the thickness of the unpressed paper. By this the paper is imparted a high bulk and by that a high absorption capacity and a high softness. Besides the paper will be elastic. At the same time a locally varying density is obtained in the paper.

The paper can also be pressed against a hard surface, e.g. a wire 11 and/or a roll 14 having a hard surface, at which the pattern of the heated roll 13 is pressed into the paper web under a heavy compression of the paper opposite the impressions, while the portions therebetween are kept uncompressed.

The pattern structure in the paper can also be made by means of a pattern band or belt which extends around and is heated by the roll 13 and is led through the press nip 12 between the roll 13 and the paper web 10.

Alternatively the paper web 10 may during the drying be supported by a wire 11 having a pattern, which is press moulded into the paper web when this passes through the press nip 12 between the rolls 13 and 14. The roll 13 can either be smooth or have an embossing pattern. In the case the roll 13 is smooth the press moulded paper will have one smooth surface and one surface with impressions. In the case the roll 13 has an embossing pattern this will also be pressed into the paper, which thus on one side will have a pattern corresponding to the structure of the wire 11 and on the opposite side having a pattern corresponding to the embossing pattern of the roll. The pattern may but need not coincide and/or be the same or different.

Possibly the paper web can after the first press nip and before winding on the wind-up roll 16 be passed through a second press nip (not shown) where a second impulse drying of the paper web takes place. This implies of course that the paper web before the second press nip is not completely dry but has a moisture content of at least 10 and preferably at least 20 weight %. This can be achieved if the drying in the first impulse drying step in the press nip 12 is not complete and/or by moistening the paper web before the second impulse drying step.

Simultaneously with the two impulse drying steps the paper web is given a three-dimensional structure. The patterns can be pressed into the paper web from opposite sides. It is of course also possible to press different patterns into the paper web from the same side. The patterns pressed into the paper web in the two impulse drying steps are preferably different.

According to one embodiment of the invention a material may be added to the paper web, said material softens or melts in the temperature interval 100–400° C. Said material can be synthetic or natural polymers with thermoplastic properties, chemically modified lignin and/or synthetic or natural polymers in the presence of softening agents. The material can either be in the form of powder, flakes, fibers or an aqueous suspension, e.g. a latex dispersion. Examples of thermoplastic polymers are polyolefines such as polyethylene and polypropylene, polyesters etc. The material can either be supplied to the entire paper web or only to the portions thereof that are intended to be located closest to the heated roll 13.

By adding to the paper web said material, which is brought to soften or melt, there is achieved an increased amount of bonding sites in the paper web. By this the basis weight variation and three-dimensional structure, that has been imparted to the paper web in connection with the combined impulse drying and press moulding, is effectively permanented. This structure is maintained also in the wet condition of the paper.

Paper can be produced by a number of different pulp types. If one disregards recovery pulp, which today is used to a great extent mainly for toilet paper and kitchen rolls, the most commonly used pulp type for soft paper is chemical pulp. The lignin content in such pulp is practically zero and the fibers, which mainly consist of pure cellulose, are relatively thin and flexible. Chemical pulp is a low yield pulp since it gives a yield of only about 50% calculated on the wooden raw material used. It is therefore a relatively expensive pulp.

It is therefore common to use cheaper so called high yield pulps, e.g. mechanical, thermomechanical pulp, chemomechanical pulp (CMP) or chemothermomechanical pulp (CTMP) in soft paper as well as in other types of paper, e.g. newsprint paper, cardboard etc. In high yield pulps the fibers are coarser and contain a high amount of lignin, resins and hemicellulose. The lignin and the resins gives the fibers more hydrophobic properties and a reduced ability to form hydrogen bonds. The addition of a certain amount of chemothermomechanical pulp in soft paper has due to the reduced fiber—fiber bonding a positive effect on properties like bulk and absorption capacity.

A special variant of chemothermomechanical pulp (CTMP) is so called high temperature chemothermomechanical pulp (HT-CTMP), the production of which differs from the production of CTMP of conventional type mainly by using a higher temperature for impregnation, preheating and refining, preferably no lower than 140° C. For a more detailed description of the production method for HT-CTMP reference is made to WO 95/34711. Characterizing for HT-CTMP is that it is a long fibrous-, easily dewatered- and bulky high yield pulp with a low shives content and low fines content.

It has according to the invention been found that high yield pulp is especially suitable for impulse drying since it is pressure insensitive, easily dewatered and has an open structure which admits the generated steam to pass through. This minimizes the risk for the paper to be overheated and destroyed during the impulse drying, which is performed at considerably higher temperatures than in other drying methods. The pressure insensitivity and the open structure depends on that the fibers in high yield pulp are relatively coarse and stiff as compared to the fibers in chemical pulp.

A further advantage is that the three-dimensional pattern given the paper is essentially maintained also in wet condition of the paper, since it is imparted to wet the wet paper web simultaneously with the drying thereof. Impulse drying further takes place at a considerably higher temperature than e.g. Yankee drying or through-air-drying, at which according to a theory, to which however the invention is not bound, the softening temperature of the lignin present in the high yield pulp is reached during the simultaneous impulse drying and press moulding. When the paper becomes cooler the lignin stiffens again and contributes in permanenting the three-dimensional structure that has been given the paper. This is therefore essentially maintained also in the wet condition of the paper, which strongly improves the bulk and absorption qualities of the paper.

According to one embodiment of the invention the paper contains a certain amount of a high yield pulp, said amount should be at least 10 weight % calculated on the dry fiber weight, preferably at least 30 weight % and more preferably at least 50 weight %. Admixture of a certain amount of another pulp with high strength properties, such as chemical pulp, preferably long-fibrous kraft pulp, or recycled pulp, is an advantage if a high strength of the paper is aimed at. The invention is however not bound to the use of a certain type of pulp in the paper, but can be applied with any optional pulp type or mixture of pulp types.

According to a further embodiment of the invention the paper web 10 can in connection with forming and dewatering be given a variation in basis weight in a non-random pattern. This can for example be provided by forming and dewatering the paper web on a wire, belt or band the dewatering capacity of which varies according to a certain pattern and where the differences in dewatering capacity involves a certain displacement of fibers and by that a local change of the basis weight of the paper web.

The basis weight variation that is given the paper web 10 in connection with forming and dewatering is permanented in the subsequent impulse drying step, at which the structure is essentially maintained also in the wet condition of the paper.

According to a further embodiment of the invention the paper web has a varying material composition as seen in its thickness direction, in such a way that it at least in the layer(s) that will be located closest to heated roll 13 in connection with the impulse drying contains a certain amount of a material which softens, melts or hardens in the temperature interval 100–400° C. By this the paper will get a surface layer which contributes in reinforcing the structural stability of the paper also in wet condition. The pulp composition in the rest of the paper layers can on the other hand be chosen for optimizing other properties such as softness, strength, bulk and draping qualities.

Said material which in connection with impulse drying softens, melts or hardens can consist of a wet strength agent, synthetic or natural polymers with thermoplastic properties, chemically modified lignin and/or synthetic or natural polymers in the presence of softening agents or of a lignin-containing high yield pulp.

Common additives such as wet strength agents, softening agents, fillers etc may of course also be used in the paper. The paper web can after impulse drying undergo different types of per se known treatments such as addition of different chemicals, further embossing, lamination etc. It is also possible when transferring the paper web between two different wires, e.g. from a dewatering wire to a drying wire, to have a speed difference between the wires so that the paper web is slowed down in connection with the transfer. The paper web will then be compacted to a certain extent, which further increases the softness qualities.

What is claimed is:

1. Method of producing a paper having a three dimensional pattern of alternating raised and recessed portions by impulse drying, comprising the steps of:

passing a wet paper web through at least one press nip having a rotatable heated roll;

imparting a three dimensional pattern of alternating raised and recessed portions to the paper web during passage through the at least one press nip using at least one of a patterned wire, band or belt and a pattern on the heated roll, said imparting step pressing the three dimensional pattern into the paper web against a counter means; and withdrawing the paper web without creping so as to maintain the three dimensional pattern imparted in said imparting step, wherein after the press nip, the paper web is led around at least 180° of the periphery of the heated roll in order to provide an additional drying of the paper web while the paper web is still in contact with the heated roll.

2. Method as claimed in claim 1, wherein the paper web encloses at least 270° of the periphery of the heated roll.

3. Method as claimed in claim 1, further comprising an additional step of heating the paper web in an after-drying section.

4. Method as claimed in claim 1, characterized in that the counter means (11, 14) is provided with a non-rigid surface so that the paper web is given a three dimensional structure having a total thickness greater than the thickness of the unpressed paper web.

5. Method as claimed in claim 4, characterized in that the paper web is supported by a compressible press felt (11) through the press nip (12), said press felt makes said non-rigid counter means.

6. Method as claimed in claim 5, characterized in that the press felt (11) is pressed against a resilient surface (14) in the press nip (12).

* * * * *